US007066564B2

(12) United States Patent
Holstun et al.

(10) Patent No.: US 7,066,564 B2
(45) Date of Patent: Jun. 27, 2006

(54) SELECTION OF PRINTING CONDITIONS TO REDUCE INK AEROSOL

(75) Inventors: Clayton L. Holstun, San Marcos, CA (US); Stuart D. Asakawa, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 196 days.

(21) Appl. No.: 10/062,926

(22) Filed: Jan. 31, 2002

(65) Prior Publication Data

US 2003/0142152 A1 Jul. 31, 2003

(51) Int. Cl.
*B41J 29/38* (2006.01)

(52) U.S. Cl. ..... 347/9; 347/23

(58) Field of Classification Search ..... 347/9, 347/5, 20, 22, 23, 35, 36, 34; B41J 29/38, B41J 2/165

See application file for complete search history.

(56) References Cited

U.S. PATENT DOCUMENTS 4,521,805 A * 6/1985 Ayata et al. ..... 358/501
5,563,639 A * 10/1996 Cameron et al. ..... 347/34
5,739,828 A * 4/1998 Moriyama et al. ..... 347/9
5,774,141 A * 6/1998 Cooper et al. ..... 347/34
6,065,830 A * 5/2000 Hiramatsu et al. ..... 347/104
6,086,180 A * 7/2000 Sugimoto et al. ..... 347/14
6,203,135 B1 3/2001 Murcia et al.
6,203,152 B1 3/2001 Boleda et al.
6,244,683 B1 6/2001 Alvarez et al.
6,318,838 B1 11/2001 Anderson et al.
6,328,413 B1 12/2001 Rutland et al.
6,340,216 B1 * 1/2002 Peeters et al. ..... 347/21
6,543,871 B1 * 4/2003 Rosen et al. ..... 347/15
6,561,621 B1 * 5/2003 Webster et al. ..... 347/34
6,669,323 B1 * 12/2003 Harriman et al. ..... 347/19

* cited by examiner

*Primary Examiner*—Manish Shah

*Assistant Examiner*—Leonard Liang

(57) ABSTRACT

Aerosol emissions within an inkjet printer are reduced. A printhead of the inkjet printer is fired using a first set of firing conditions when firing conditions are critical for printing performance. When firing conditions are not critical for printing performance, the printhead is fired using a second set of firing conditions. The second set of firing conditions is optimized to provide reduction of aerosol jets.

30 Claims, 4 Drawing Sheets

SELECTION OF PRINTING CONDITIONS TO REDUCE INK AEROSOL

BACKGROUND

Inkjet printing mechanisms use moveable cartridges, also called pens, that use one or more printheads formed with very small nozzles through which drops of liquid ink (i.e., dissolved colorants or pigments dispersed in a solvent) are fired. To print an image, the carriage traverses over the surface of the print medium, and the ink ejection elements associated with the nozzles are controlled to eject drops of ink at appropriate times pursuant to command of a microcomputer or other controller. The pattern of pixels on the print media resulting from the firing of ink drops results in the printed image.

During printing, ink aerosol can be generated. The aerosol is composed of minute ink particles or satellites that become detached from a main ink droplet. Aerosol drops can make printers dirty, stain the output, and even hurt functionality by coating internal printing operating parts such as encoder strips or sensors.

There are several occasions beyond normal printing where aerosol can occur. For example, aerosol can occur during tube purging, printhead start-up, printhead servicing, drop detection, setting the thermal turn on voltage (TTOV), and printing alignment marks, spit strips, or fiducials that are eventually cut off a page. There are also certain printer operations, such as overprinting and underprinting black ink with color, when the printing conditions are somewhat arbitrary.

The effect of aerosol tends to be more pronounced during servicing than during printing. Printhead servicing generally includes a process known as "spitting." Spitting is the ejection of non-printing ink drops into a spittoon within the service station. During spitting, the typical spittoon target area is farther from the printhead than is the print media during printing. For example, during normal printing, the printhead is usually spaced approximately one millimeter (1 mm) above the print media. When spitting, an ink drop from may need to travel a distance greater than five millimeters (>5 mm) to reach the spittoon target surface. Such an increased distance tends to create more aerosol.

In order to reduce inkjet aerosol, various methods have been used. These include modifying physical components such as spittoons and absorbers to try and catch more aerosol. This has been profitable in some cases, but has not completely eliminated the problem of contamination by aerosol. Other solutions, such as forced ventilation provided by one or more fans, have been tried. However, this has resulted in an increase both in manufacturing costs (e.g., due to increased complexity of the printer) and operational costs (e.g., due to increased electricity consumption) of printers.

SUMMARY OF THE INVENTION

In accordance with the preferred embodiment of the present invention, aerosol emissions within an inkjet printer are reduced. A printhead of the inkjet printer is fired using a first set of firing conditions when firing conditions are critical for printing performance. When firing conditions are not critical for printing performance, the printhead is fired using a second set of firing conditions. The second set of firing conditions is optimized to provide reduction of aerosol jets.

DESCRIPTION OF THE PREFERRED EMBODIMENT

Figure 1:
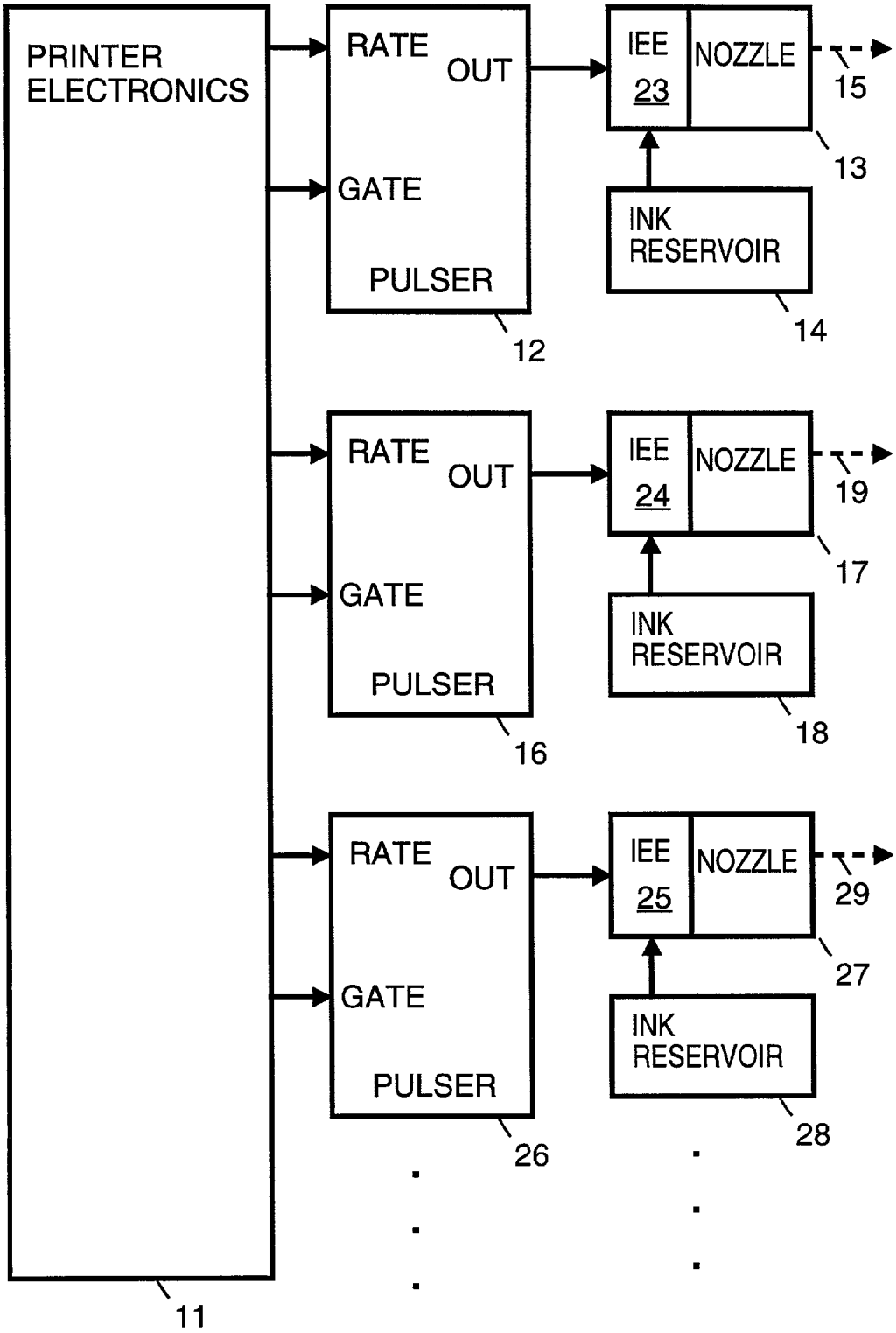
FIG. 1 is a simplified block diagram of print electronics in an inkjet printer usable with an embodiment of the present invention.

FIG. 1 shows print electronics 11. Print electronics 11 takes input data and generates printhead firing data. The input data includes, for example, information describing printed characters and/or images for printing. For example, input data is in a printer format language such as Postscript, PCL 3, PCL 5, HPGL, HPGL 2 or some related version of these. Alternatively, the input data may be formatted as raster data or formatted in some other printer language. The printhead firing data is used to control the ejection elements associated with the nozzles of an ink jet printer, such as for thermal ink jet printer, piezo ink jet printers or other types of ink jet printers.

For example, as shown in FIG. 1, printhead firing data is used by a pulser 12 to generate pulses that control an ink ejection element (IEE) 23 associated with a nozzle 13 located on a first printhead. Pulser 12 may be located on or off the printhead, depending on the particular implementation of the present invention. In the example shown in FIG. 1, printer electronics provides to pulser 12 printhead firing data on two lines. Information on the first line sets the pulse rate and information on the second line indicates which pulses are to be forwarded to ink ejection element 23. The pulses forwarded to ink ejection element 23 are forwarded as a current pulse that is applied to a resistor within ink ejection element 23. The current pulse causes an ink droplet 15, formed with ink from an ink reservoir 14, to be emitted from nozzle 13.

Often, printers included multiple printheads. Thus, printhead firing data generated by printer electronics 11 is also used by a pulser 16 to generate pulses which control an ink ejection element (IEE) 24 associated with a nozzle 17 located on a separate (second) printhead. Pulser 16 may be located on or off the second printhead, depending on the particular implementation of the present invention. Printer electronics provides to pulser 16 printhead firing data on two lines. Information on the first line sets the pulse rate and information on the second line indicates which pulses are to be forwarded to ink ejection element 24. The pulses forwarded to ink ejection element 24 are forwarded as a current pulse that is applied to a resistor within ink ejection element 24. The current pulse causes an ink droplet 19, formed with ink from an ink reservoir 18, to be emitted from nozzle 17.

The printhead firing data is also used by a pulser 26 to generate pulses which control an ink ejection element (IEE) 25 associated with a nozzle 27 located on a third printhead. Pulser 26 may be located on or off the printhead, depending on the particular implementation of the present invention. Printer electronics provides to pulser 26 printhead firing data on two lines. Information on the first line sets the pulse rate and information on the second line indicates which pulses are to be forwarded to ink ejection element 25. The pulses forwarded to ink ejection element 25 are forwarded as a current pulse that is applied to a resistor within ink ejection element 25. The current pulse causes an ink droplet 29, formed with ink from an ink reservoir 28, to be emitted from nozzle 27.

In a thermal system, within each nozzle, a barrier layer contains ink channels and vaporization chambers. The barrier layer is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the nozzle is fired to expel ink drops.

Figure 2:
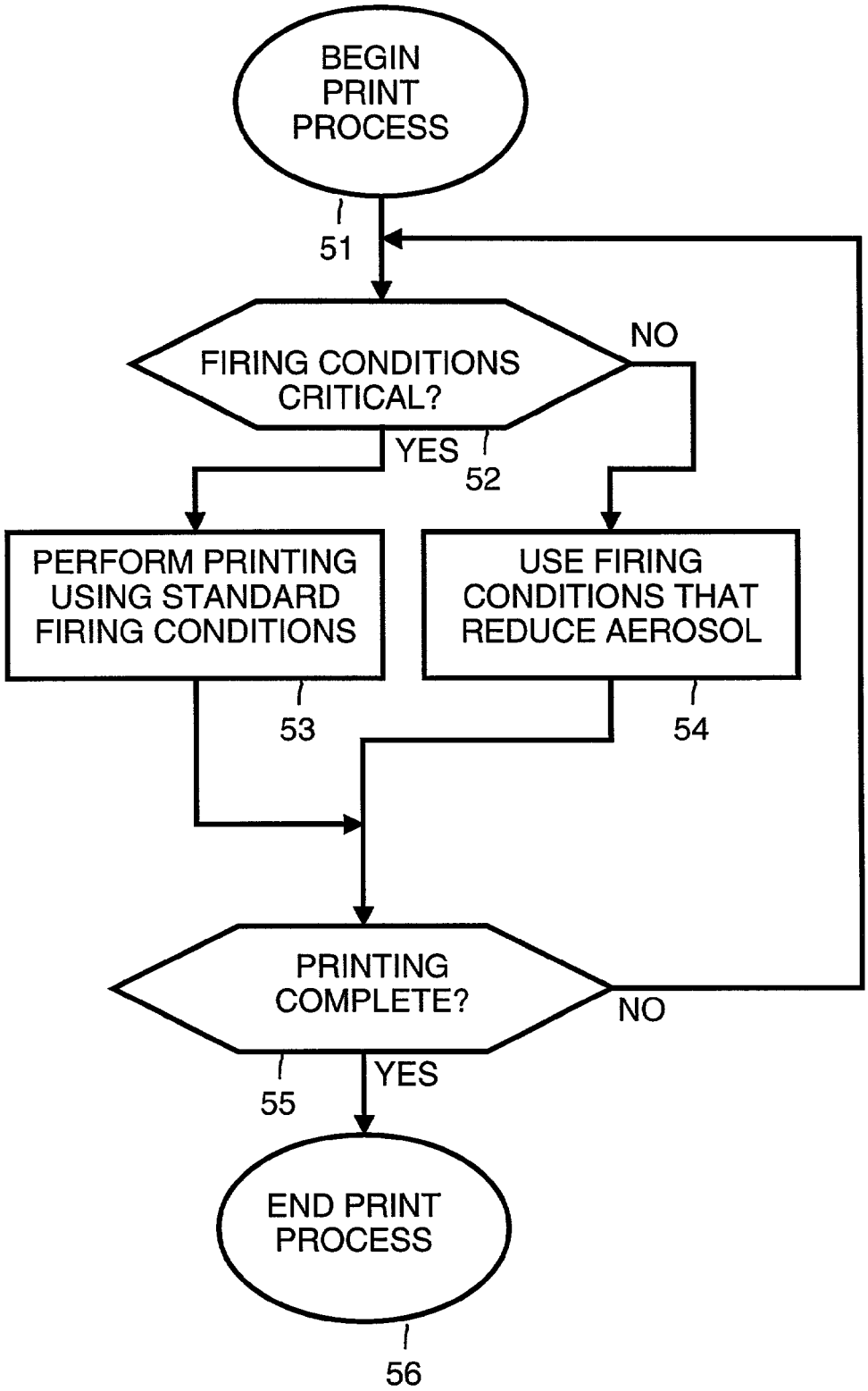
FIG. 2 is a flowchart that illustrates a method to reduce aerosol when operating the print electronics shown in FIG. 1 in accordance with an embodiment of the present invention.

FIG. 2 is a flowchart that illustrates a method to reduce aerosol when operating the print electronics shown in FIG. 1.

At a block 51, a print process begins. At a block 52, a check is made to see whether firing conditions are critical for printing performance. For example, firing conditions are not considered critical during spitting and other types of printhead servicing. Likewise, firing conditions are often not considered critical during underprinting (i.e., something will be printed on top) or during overprinting (i.e., something was already printed underneath).

If in block 52 firing conditions are critical, at a block 53, printing is performed using standard firing conditions. If in block 52, firing conditions are not critical, at a block 54, firing conditions are used that reduce aerosol. At a next break in printing, a check is made in block 55 as to whether printing is complete. If so at a block 56, the print process is completed. If not, in block 52, a check is made to see whether firing conditions are critical in the next printing phase of the print process. A print phase can begin at the beginning of a print job, between pages of a print job or even within a page of a print job. A print phase also can begin upon printer initialization and so on. A print process can be any occasion of print activity including, but not limited to, a print job, print servicing or printer initialization.

There are a number of firing conditions that can be modified to reduce aerosol. For example, aerosol can be reduced by changing the firing frequency of nozzles, timed firing of adjacent nozzles, firing continuous bursts from a single nozzle, firing when a printhead carriage is not moving, and/or decreasing the temperature at which nozzles are fired.

Higher firing frequencies can reduce or eliminate aerosol jets. For example, depending upon inks and other operating conditions an aerosol jet present at a firing frequency of 4 kHz can be suppressed or reduced by increasing the firing frequency by 1 kHz to 5 kHz. Increasing firing frequency can reduce an aerosol jet, for example, because it may result in an aerosol drop being swallowed by a subsequently fired drop.

Also at higher frequencies, puddles form on the external surface of the nozzle and suppress aerosol droplets. When a firing burst is sufficiently long, a puddle can fill the counterbore of a nozzle and suppress an aerosol jet.

Timed firing of adjacent nozzles can reduce or eliminate aerosol jets by entraining enough air to sweep the aerosol droplets and pull the aerosol droplets straight down and away from the printhead. As first some, and then more adjacent nozzles are fired, more and more air is entrained by the main jets. This entrained air pulls any aerosol jet down away from the printhead and keeps the aerosol from scattering to unwanted sections of the printer.

This same principle applies when firing a single nozzle or a sparse array of nozzles. Firing a longer burst of drops from a single nozzle will build up a stream of entrained air around the drop stream that will pull the aerosol droplets straight down and away from the printhead. Firing from a stationary printhead carriage intensifies this single nozzle effect and the effect of timed firing of adjacent nozzles.

Typically when performing a printing operation, firing frequency is variable and based on image content and print mode. When minimizing aerosol, a constant frequency can be chosen using the above-discussed criteria to reduce aerosol.

Lowering firing temperature can also be used to reduce aerosol. Typically, firing temperature is selected based on drop weight consistency, nozzle health (i.e., to prevent a nozzle from becoming crusted over with residue), and reliability. During not-critical parts of a print process (e.g., during printhead servicing), firing temperature can be lowered to reduce aerosol. For example, a 10 degree lowering of firing temperature (e.g., from 55 degrees C. to 45 degrees C.) can have a significant impact in reducing aerosol.

Occasionally, it is beneficial to generate aerosol. For example, when a printhead goes into a capping station with dry air in it, water must evaporate from the nozzles to humidify that air and to keep it humidified if there are any leaks. This loss of water from the nozzle region creates a hard or soft plug in the nozzle, which can be difficult to remove. If the air is humidified by firing a printhead after the printhead is in the capper, and especially if the firing is tuned to create aerosol droplets that will more quickly humidify the air, this can be beneficial for printer performance. It is possible in many cases to generate more aerosol, for example, by increasing firing temperature or decreasing firing frequency.

Figure 3:
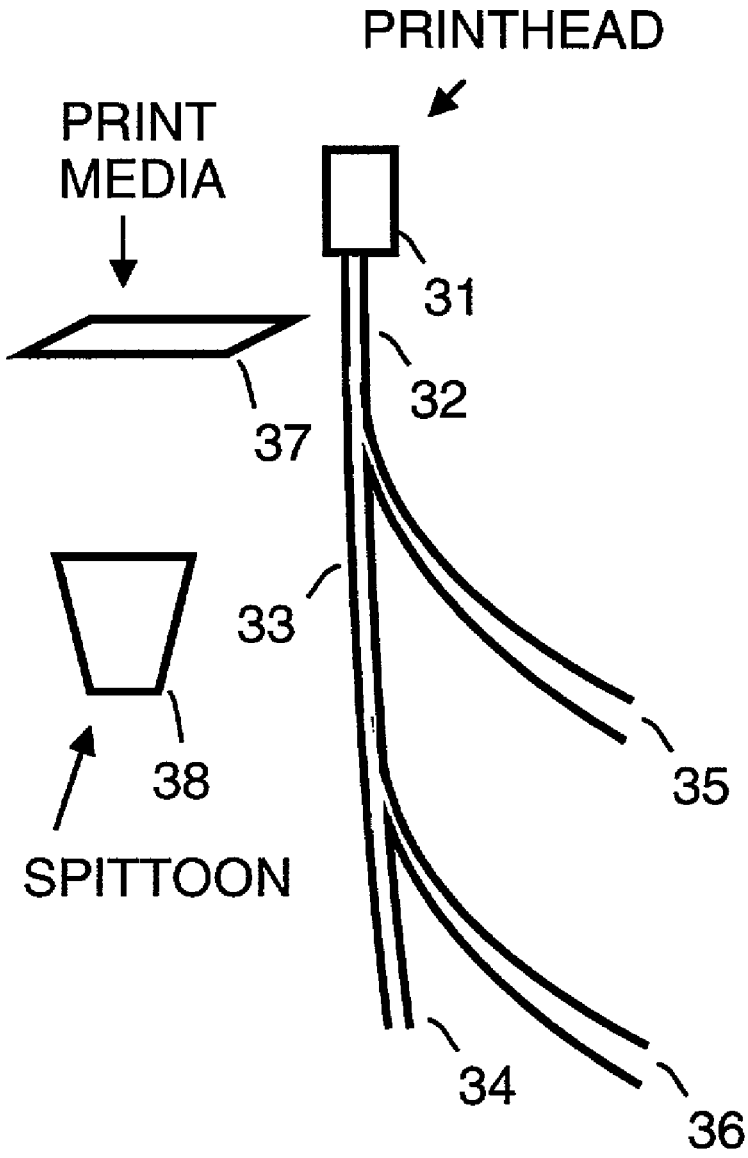
FIG. 3 and FIG. 4 illustrate reduction of aerosol when operating the print electronics shown in FIG. 1 in accordance with an embodiment of the present invention.
Figure 4:
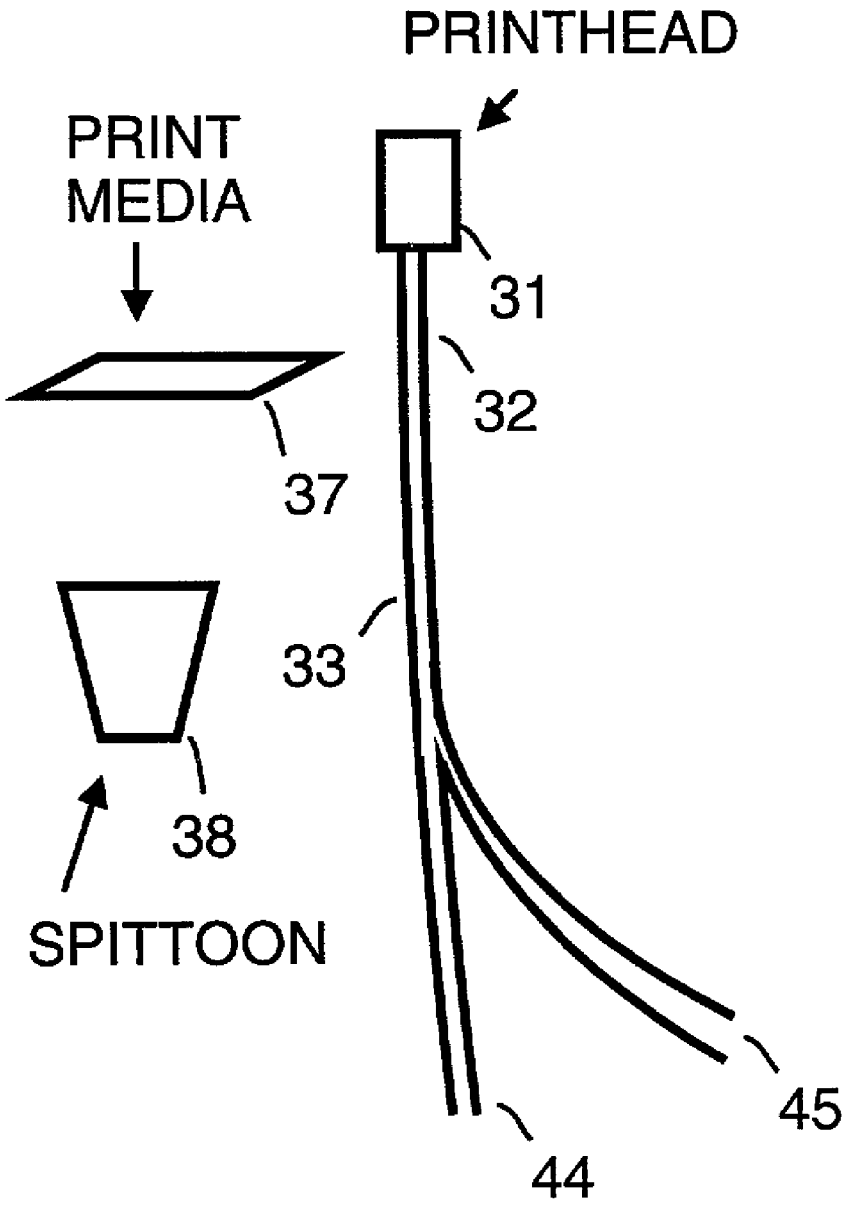

FIG. 3 and FIG. 4 illustrate reduction of aerosol when operating using standard firing conditions and using firing conditions that reduce aerosol.

FIG. 3 represents operation using standard firing conditions. A printhead 31 includes, for example, nozzle 13, ink reservoir 14 and pulser 12 (shown in FIG. 1). Printhead 31 fires an ink drop as represented by an ink jet 34. The natural path of ink jet 34 is shown as if there is no print media. For example, a location 32 indicates a distance that a print media 37 might be placed. For example, location 33 indicates a distance that a spittoon target 38 might be placed for use during spitting. As seen in FIG. 3, an aerosol jet 35 and an aerosol jet 36 break off from ink jet 34. Aerosol jet 35 and aerosol jet are shown only for illustrative purposes. The existence, location and number of aerosol jets is highly dependent on a number of factors including, but not limited to, firing temperature, firing frequency, ink composition, and so on.

As shown by FIG. 3, aerosol jet 35 breaks off after location 32, and before location 33. This indicates that in normal printing, aerosol jets should not be a factor when printing on print media, but can cause trouble during performance of spitting. Aerosol jet 36 breaks off after location 33. This indicates that aerosol jet 36 should not be a factor when printing on print media or during performance of spitting.

FIG. 4 represents operation using firing conditions that reduce aerosol. For example, firing conditions are changed by increasing firing frequency, timed firing of adjacent nozzles, and/or reduction of the operating temperature.

Printhead 31 fires an ink drop as represented by an ink jet 44. The natural path of ink jet 44 is shown as if there is no media. As in FIG. 3, location 32 indicates a distance that print media 37 might be placed. Location 33 indicates a distance that a spittoon target 38 might be placed. As seen in FIG. 4, an aerosol jet 45 breaks off from ink jet 34. Aerosol jet 45 is shown only for illustrative purposes. The existence, location and number of aerosol jets is highly dependent on a number of factors including firing temperature, firing frequency, ink composition, and so on.

As shown by FIG. 4, aerosol jet 45 breaks off after location 32 and after location 33. This indicates that aerosol jet 45 should not be a factor when printing on print media or during performance of spitting. Thus, firing conditions have been successfully changed to suppress the existence of an aerosol jet during printing and during printhead servicing.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure of the present invention is intended to be illustrative, but not limiting, of the scope of the invention, which is set forth in the following claims.

We claim:

1. A method for printing, the method comprising:

(a) firing ink drops using a first set of firing conditions when firing conditions are critical for printing performance, the first set of firing conditions being optimized to provide superior printing performance; and, (b) firing ink drops using a second set of firing conditions when firing conditions are not critical for printing performance, the second set of firing conditions being optimized to provide reduction in amount of ink aerosol generated during firing of ink drops.

2. A method as in claim 1 wherein firing conditions are not considered critical for printing performance during spitting.

3. A method as in claim 1 wherein firing conditions are not considered critical for printing performance during underprinting and during overprinting.

4. A method as in claim 1 wherein firing conditions are not considered critical for printing performance during printhead servicing.

5. A method as in claim 1 wherein the first set of firing conditions includes a first firing frequency that is variable and based on image content and print mode, and the second set of firing conditions includes a second firing frequency that is constant.

6. A method as in claim 1 wherein the first set of firing conditions includes a firing temperature that is higher than a second firing temperature included in the second set of firing conditions.

7. A method as in claim 1 wherein the second set of firing conditions includes timed firing of adjacent nozzles.

8. A method as in claim 1 wherein the second set of firing conditions includes a long burst of firings from a single nozzle.

9. A method as in claim 1 wherein the second set of firing conditions includes firing ink drops when a printhead carriage is not moving.

10. A method as in claim 1 wherein the second set of firing conditions includes firing a burst of ink drops when a printhead carriage is not moving.

11. An inkjet printer comprising:

a printhead; and, printer electronics for controlling firing conditions within the printhead, the printer electronics controlling the firing conditions by using a first set of firing conditions when firing conditions are critical for printing performance, the first set of firing conditions being optimized to provide superior printing performance;

wherein the printer electronics uses a second set of firing conditions when firing conditions are not critical for printing performance, the second set of firing conditions being optimized to provide reduction in amount of ink aerosol generated by the printhead.

12. An inkjet printer as in claim 11 wherein the first set of firing conditions includes a first firing frequency that is variable and based on image content and print mode, and the second set of firing conditions includes a second firing frequency that is constant.

13. An inkjet printer as in claim 11 wherein the first set of firing conditions includes a firing temperature that is higher than a second firing temperature included in the second set of firing conditions.

14. An inkjet printer as in claim 11 wherein the inkjet printer additionally comprises timed firing of adjacent nozzles.

15. An inkjet printer as in claim 11 wherein the second set of firing conditions includes a long burst of firings such that ink aerosol generated by a first drop is captured by a following drop.

16. An inkjet printer as in claim 11 wherein the second set of firing conditions includes firing ink drops when a printhead carriage is not moving.

17. An inkjet printer as in claim 11 wherein the second set of firing conditions includes firing a burst of ink drops when a printhead carriage is not moving.

18. A method for reducing aerosol emissions within an inkjet printer, the method comprising:

(a) firing a printhead of the inkjet printer using a first set of firing conditions when firing conditions are critical for printing performance; and, (b) firing the printhead using a second set of firing conditions when firing conditions are not critical for printing performance, the second set of firing conditions being optimized to provide reduction in amount of ink aerosol within aerosol jets generated during the firing of the printhead.

19. A method as in claim 18 wherein firing conditions are not considered critical for printing performance during spitting.

20. A method as in claim 18 wherein firing conditions are not considered critical for printing performance during printhead servicing.

21. A method as in claim 18 wherein the first set of firing conditions includes a first firing frequency that is variable and based on image content and print mode, and the second set of firing conditions includes a second firing frequency that is constant.

22. A method as in claim 18 wherein the first set of firing conditions includes a firing temperature that is higher than a second firing temperature included in the second set of firing conditions.

23. A method as in claim 18 wherein the second set of firing conditions includes timed firing of adjacent nozzles.

24. A method as in claim 18 wherein firing conditions are not considered critical for printing performance during underprinting and during overprinting.

25. A method as in claim 18 wherein the second set of firing conditions includes a long burst of firings such that the aerosol generated by a first drop is captured by a following drop.

26. A method as in claim 18 wherein the second set of firing conditions includes firing ink drops when a printhead carriage is not moving.

27. A method as in claim 18 wherein the second set of firing conditions includes firing a burst of ink drops when a printhead carriage is not moving.

28. An inkjet printer comprising:

a printhead means for firing ink drops; and, printer electronics means for controlling firing conditions within the printhead means, the printer electronics means controlling the firing conditions by using a first set of firing conditions when firing conditions are critical for printing performance, the first set of firing conditions being optimized to provide superior printing performance;

wherein the printer electronics means uses a second set of firing conditions when firing conditions are not critical for printing performance, the second set of firing conditions being optimized to provide reduction in amount of ink aerosol generated by the printhead means.

29. An inkjet printer as in claim 28 wherein the first set of firing conditions includes a first firing frequency that is variable and based on image content and print mode, and the second set of firing conditions includes a second firing frequency that is constant.

30. An inkjet printer as in claim 28 wherein the first set of firing conditions includes a firing temperature that is higher than a second firing temperature included in the second set of firing conditions.

* * * * *